US006890051B2

(12) United States Patent
Otis, Jr.

(10) Patent No.: US 6,890,051 B2
(45) Date of Patent: May 10, 2005

(54) METHODS AND APPARATUS FOR REDUCING THE PRINT-JOB COMPLETION TIME FOR A PRINTER HAVING AN INTERMITTENT-REFILL PRINTHEAD

(75) Inventor: David R. Otis, Jr., Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/425,366

(22) Filed: Apr. 29, 2003

(65) Prior Publication Data

US 2004/0217994 A1 Nov. 4, 2004

(51) Int. Cl.[7] ..... B41J 29/393; B41J 29/38
(52) U.S. Cl. ..... 347/19; 347/14
(58) Field of Search ..... 347/7, 14, 19

(56) References Cited

U.S. PATENT DOCUMENTS 6,155,664 A * 12/2000 Cook ..... 347/7
6,362,868 B1 * 3/2002 Silverbrook ..... 355/18
6,454,381 B1 * 9/2002 Olsen et al. ..... 347/19
6,788,903 B1 9/2004 Mayer et al.

* cited by examiner

*Primary Examiner*—Stephen D. Meier
*Assistant Examiner*—Alfred Dudding
(74) *Attorney, Agent, or Firm*—Larry Baker

(57) ABSTRACT

Methods and apparatus are disclosed for reducing the print-job completion time in a printing system having at least one printhead that is intermittently refilled from an "off-axis" ink supply during non-printing intervals. A reduced refill time is determined from an estimation of the amount of ink expended since the printhead was previously refilled, and on a characterization of the ink refill behavior of the printing system. The refill behavior of the printing system may be quantified in data stored in a memory device integral with a replaceable ink supply.

26 Claims, 8 Drawing Sheets

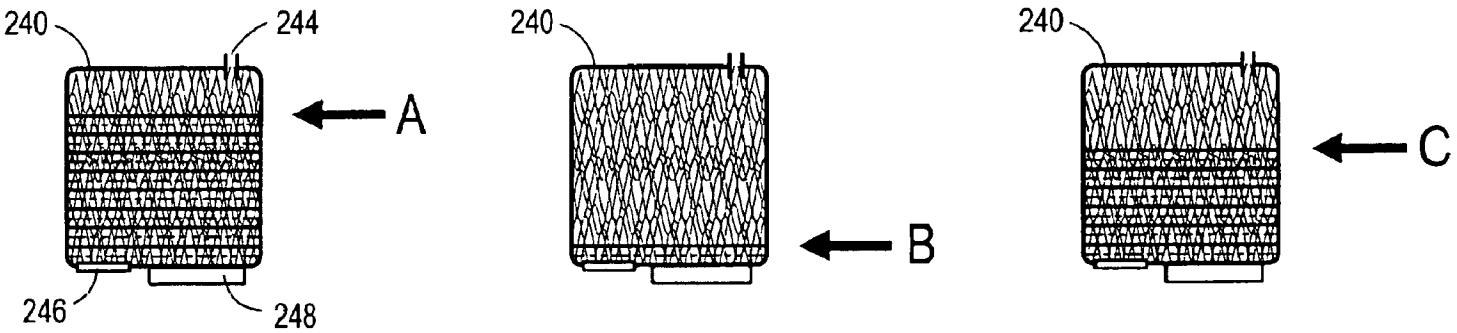
Fig. 2(a)
Fig. 2(b)
Fig. 2(c)
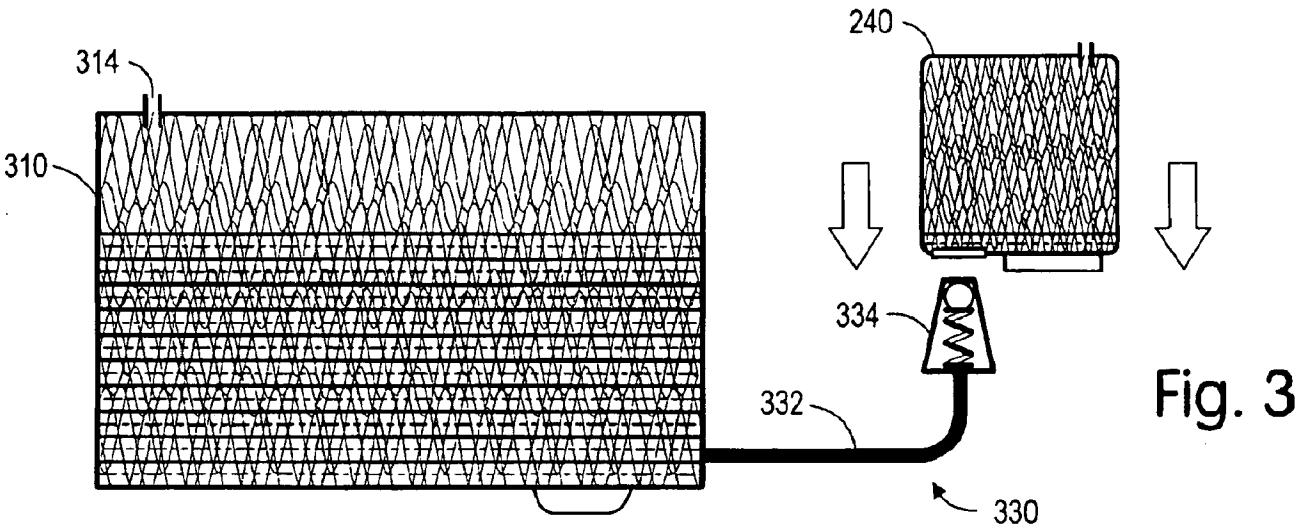
Fig. 3

METHODS AND APPARATUS FOR REDUCING THE PRINT-JOB COMPLETION TIME FOR A PRINTER HAVING AN INTERMITTENT-REFILL PRINTHEAD

TECHNICAL FIELD OF THE INVENTION

The present invention relates generally to printing systems, and more specially to methods and apparatus for reducing the print-job completion time for a printer having an intermittent-refill printhead.

BACKGROUND OF THE INVENTION

Inkjet printers are well known in the art. Inkjet technology enables the printing of text and images by depositing very small droplets of ink onto a print medium, such as paper. Inkjet printheads are typically secured to a scanning carriage that traverses the print medium in a direction transverse to the direction of travel of the print media through the printer. Each printhead includes multiple tiny ink ejection elements formed in a substrate that are selectively "fired" by electrical signals, causing droplets of ink to be ejected in a controlled fashion onto the print medium.

Inkjet printers typically utilize replaceable ink supplies, which may be either integral with the printheads (in the form of "print cartridges"), or separate from the printheads (sometimes referred to as "separate ink and silicon"). When the printheads are integral with the ink supplies, the printheads are replaced each time new ink supplies are installed in the printer. When separate from the replaceable ink supplies, the printheads may be permanent or semi-permanent, with an ink delivery system routing ink from the supplies to the printheads. Since printheads are relatively expensive, "separate ink and silicon" configurations typically allow for a lower total cost of printer ownership.

If permanent or semi-permanent printheads are used, the replaceable ink supplies may be located remotely from the printheads and off the scanning carriage (referred to as "off-axis"). Locating the ink supplies off-axis reduces the scanning carriage mass and swept volume, which typically allows for mechanically simpler and more compact printer systems. For examples of off-axis printing systems, refer to U.S. Pat. No. 4,831,389 (Chan) which shows a multicolor off-board ink supply system; U.S. Pat. No. 4,929,963 (Balazar) which demonstrates an ink delivery system for an inkjet printer using a low pressure recirculating pumping system; and U.S. Pat. No. 4,968,998 (Allen) which teaches an inkjet pen which is refillable at a "service station."

One competitive market segment for inkjet printers is very-low-cost compact printers. To be cost competitive, printers in this market segment must be mechanically simple with a low cost of ownership. One design approach in this market segment is the use of printheads that carry a small volume of ink, sufficient to complete only a portion of a print job, and that are periodically refilled during non-printing intervals from off-axis ink supplies. A printer may, for example, have a local ink reservoir in the printhead that carries only enough ink to complete a single very dense page, such as a dark photograph.

In printing systems utilizing the intermittent refill of the printhead, the intermittent refill may be performed by periodically connecting the printhead to the ink delivery system, or by periodically activating an ink delivery system that is permanently connected to the printhead, such as through tubes. Intermittent refill can simplify the design of the printhead, since the printhead need not cope with the effects of ink delivery while printing, such as pressure excursions.

A drawback of intermittent refill of the printhead, however, is that the time to complete a print job is increased by the non-printing latency time required for refill of the printhead. For example, if refilling of the printhead relies on the effects of gravity or capillary affinities to move ink from the ink supply to the printhead, the refill time may become a significant portion of the total time required to complete a print job.

There is therefore a need for methods and apparatus for reducing the print-job completion time for printers having intermittent-refill printheads.

SUMMARY OF THE INVENTION

Exemplary embodiments of the invention include methods and apparatus for reducing the print-job completion time in a printing system having at least one printhead that is intermittently refilled from an "off-axis" ink supply during non-printing intervals. A reduced refill time is determined from an estimation of the amount of ink expended since the printhead was previously refilled, and on a characterization of the ink refill behavior of the printing system. The refill behavior of the printing system may be quantified in data stored in a memory device integral with a replaceable ink supply.

Other aspects and advantages of the present invention will become apparent from the following detailed description, taken in conjunction with the accompanying drawings, illustrating by way of example the principles of the invention.

BRIEF DESCRIPTION OF THE DRAWINGS

These and other features and advantages of the present invention will become more apparent from the following detailed description of exemplary embodiments thereof, as illustrated in the accompanying drawings, in which:

FIGS. 2(*a*), 2(*b*), and 2(*c*) illustrate an exemplary printhead with a "local" ink reservoir containing a capillary material: FIG. 2(*a*) illustrates the printhead with a full ink reservoir; FIG. 2(*b*) illustrates the printhead with a substantially depleted reservoir; and FIG. 2(*c*) illustrates the printhead with a partially depleted reservoir.

FIG. 3 illustrates one mechanism by which the local ink reservoir of the exemplary printhead of FIGS. 2(*a*) through 2(*c*) may be refilled.

FIG. 8(*a*) illustrates the supply, ink delivery system, and printhead while printing; and FIG. 8(*b*) illustrates the supply, ink delivery system, and printhead during refill.

DESCRIPTION OF EXEMPLARY EMBODIMENTS

Figure 1:
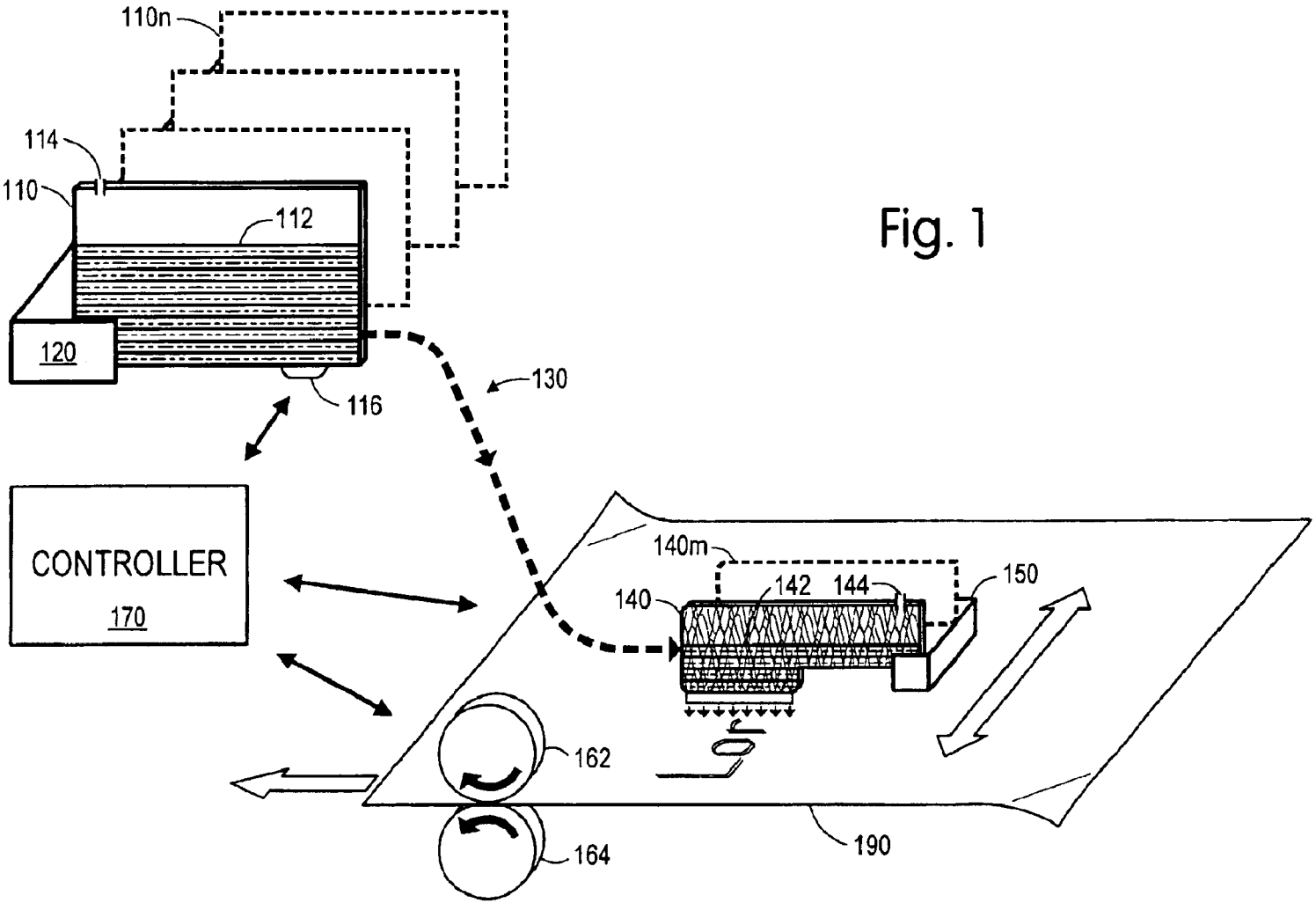
FIG. 1 is an abstracted representation of an exemplary "off-axis" printing system in which embodiments of the present invention may be used.

FIG. 1 is an abstracted representation of an exemplary "off-axis" printing system in which embodiments of the present invention may be utilized. The exemplary printing system has at least one replaceable ink supply 110 containing a quantity of ink 112. The exemplary printer may include multiple supplies, such as supplies for each of three primary colors and black, as denoted by phantom lines 110*n* in FIG. 1. The multiple supplies may be housed within a common container or may be independently replaceable, and are typically held in a stationary "off-axis" supply receiving station 120 when installed in the printer. Each replaceable supply 110 may retain the ink 112 in a capillary material (not shown in FIG. 1) such as a foam material, a fibrous material, or other substance; or the supply may contain "free ink" (ink which is not retained in a capillary material). The ink supply may include a venting mechanism 114 to maintain an appropriate pressure relationship between the interior of the supply and the ambient air, or another pressure regulating mechanism known in the art. Other configurations of ink supplies are also known in the art, such as pressurized supplies; the supplies may other supply other fluids to the printheads, such as pre-coating or over-coating "fixer" fluids.

The replaceable ink supply 110 may also include an integral memory device 116 that is programmed with information pertaining to the ink supply and the printing system. The memory device may include both non-alterable non-volatile memory, as well as memory which may be modified by the printer controller 170 or by the device to which the printer is connected, such as a computer (not shown). The memory device 116 may communicate with the controller 170 or connected device through electrical contacts on the supply that engage mating contacts in the supply receiving station 120 when the supply is installed in the receiving station, or the memory device may communicate through a wireless date link (not shown).

Ink 112 from the supply 110 is provided to a printhead 140 through an ink delivery system 130, which may take many forms (represented in FIG. 1 by a dashed line). For example, the ink delivery system may utilize "trailing tubes," in which flexible tubes connect the chassis-mounted supply the carriage-mounted printhead, or it may entail the intermittent fluidic connection of the printhead and supply (sometimes referred to as "take-a-sip"—see U.S. Pat. No. 6,302,503, "Inkjet ink level detection"). Trailing tube ink delivery systems may provide ink to the printhead through a single tube, with the ink driven through the tube by a pressure differential created by the height of the supply above the printhead or by differential capillary affinities, or may provide for the recirculation of ink through the printhead and back to the supply, with the ink typically driven by a pump. When permanent or semi-permanent printheads are used, ink recirculation can extend the useful lifetimes of the printheads by purging air from the printheads. The ink delivery system may also include one or more pressure regulating devices (not shown), configured to insure the reliable delivery of ink to the printhead. Although described as an "ink delivery system", other fluids may be provided to the printhead, such a fixer fluid.

The ink delivery system 130 may provide ink the printhead 140 on a continuous basis, or may be configured to intermittently refill the printhead during non-printing intervals. In printing systems in which embodiments of the present invention may be utilized, printhead assembly 140 periodically receives ink from the ink delivery system 130 and stores a small quantity of ink 142 in a local reservoir within the printhead assembly. The quantity of ink stored within the "local" reservoir of the printhead assembly is typically sufficient to complete at least an integral number of complete pages, such that printing need not be interrupted during the printing of a page (which could cause print quality defects, such as wait-time banding). For very-low-cost printing systems or systems in which the rapid printing of multiple pages isn't essential, the local reservoir within the printhead may be sized to be sufficient to complete just a single very dense page, such as a dark photograph or graphic.

The exemplary printer may include multiple printheads, such as printheads for each of the primary colors and black, as denoted by phantom lines 140*m*. A printhead may include a single row of ink ejection elements for printing a single ink color, or multiple rows of ink ejection elements may be incorporated into a single printhead, with each row printing a different color. The printhead is typically attached to a scanning carriage 150 that reciprocates across the print medium 190. A printhead also typically includes one or more mechanisms for controlling ink backpressure, such that ink does not "drool" from the printhead nozzles. For example, in FIG. 1 the printhead 140 is depicted with a capillary material filling its local ink reservoir, with a vent 144 to maintain a proper pressure relationship with ambient air. Many other pressure regulating mechanisms are known in the art.

The exemplary printing system may incorporate mechanisms (not shown in FIG. 1) for sensing ink levels in the supply, the ink delivery system, or the printhead. An indication of the current ink levels, such as the level within the supply 110, may be stored in the electronic memory device 116. Ink level sensors may function by detecting an electrical, physical, or optical characteristic of the ink. The direct sensing of ink levels is not always practical, however, since the cost of sensors may be prohibitive in a low-cost printing system, and accurate indications of ink level may be difficult to achieve, particularly when ink is retained in a capillary material.

The exemplary printing system of FIG. 1 also has a media handling mechanism, as represented by rollers 162, 164, which move sheets of media 190 through the printer, typically advancing the media by one printhead scan width after each pass of the carriage. Other types of media handling mechanisms and other forms of media may also be used.

A printer controller 170 typically manages all aspects of the printing process, including: controlling and monitoring the scanning carriage 150 and the media handling mechanism 162, 164; receiving print data from an external source such as a computer (not shown in FIG. 1); generating print data and control signals for the printhead; and accessing and storing information on the integral memory device 116.

FIGS. 2(*a*), 2(*b*), and 2(*c*) illustrate one exemplary embodiment of a printhead assembly 240 for a printing system utilizing intermittent replenishment of the printhead. The printhead 240 depicted in FIG. 2 has an interior volume containing a capillary material for retaining ink and a refill port 246 that allows refill of the printhead by drawing ink into the printhead through capillary affinity. The printhead also includes a printhead die 248. To maintain a proper pressure relationship to the ambient, the printhead includes a vent 244, which may, for example, be a serpentine channel allowing for pressure equalization but minimizing fluid loss. As depicted in FIG. 2(*a*), the capillary material of the printhead is substantially full of ink, as-indicated by the arrow 'A', such as would be the case immediately following a replenishment of the printhead.

FIG. 2(*b*) illustrates a printhead with a nearly-depleted local ink reservoir, as indicated by the arrow 'B'. The condition shown in FIG. 2(*b*) might result, for example, when a printhead assembly 240, configured to carry only enough ink for a single page, prints a very dense page (such as a dark photograph or illustration).

FIG. 2(*c*) illustrates a partially-depleted ink supply, as indicated by the arrow 'C'. This condition might result, for example, when a printhead assembly 240 configured to carry only enough ink for a single page prints a page of average-density text.

FIG. 3 illustrates one mechanism by which the local ink reservoir of the exemplary printhead 240 of FIGS. 2(*a*) through 2(*c*) may be refilled. Replaceable ink supply 310 is mounted in a supply receiving station of the printer (not shown in FIG. 3), as discussed above. The ink delivery system 330 includes tubes 332 or other conduits to route ink from the supply to a fluid interconnect 334, shown in FIG. 3 as a "spring-ball" interconnect. The interconnect 334 functions as a valve, which opens to allow ink flow only when the interconnect is in contact with the refill port 246 of a printhead. Other forms of interconnect are known in the art.

When the printer controller initiates a refill of the printhead local reservoir, the printer carriage is caused to bring the printhead to the fluid interconnect 334, and the refill port 246 is brought into contact with the fluid interconnect 334, opening the valve. Ink flow from the supply 310 through the ink delivery system 330 and into the printhead 240 is established, and the refill process begins. The ink flow continues until the ink level within the printhead is restored to an appropriate level, such as depicted in FIG. 2(*a*); the refill port 246 is then disconnected from the fluid interconnect 334 and the printhead is returned to a printing position.

Figure 4:
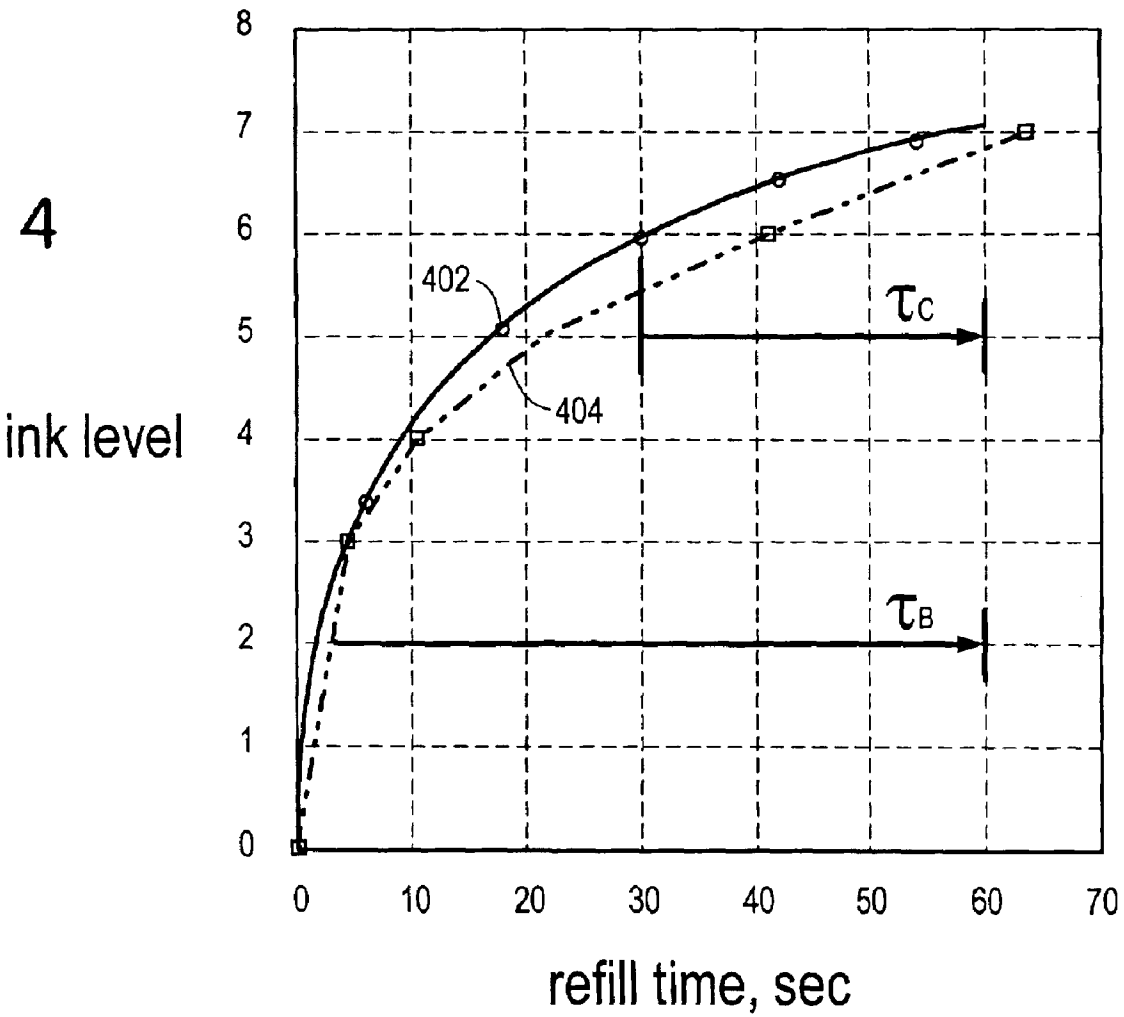
FIG. 4 is a graph illustrating the printhead refill behavior of an exemplary printing system where the refill is substantially driven by the capillarity of the material within the printhead.

FIG. 4 illustrates the refill behavior of an exemplary printhead reservoir filled with capillary material, such as that shown in FIGS. 2(*a*) through 2(*c*) and 3. As described above, the ink supply and the printhead reservoir each contain capillary material, and the refilling of the printhead is driven primarily by differences in capillary affinities. Such a configuration may be utilized, for example, in a very-low-cost compact printer. Other configurations of ink supplies, printheads, and ink delivery systems will exhibit different characteristics than shown in FIG. 4.

FIG. 4 shows both the computer-modeled refill characteristics 402 and measured refill characteristics 404 for an exemplary printing system, with the vertical scale representing the liquid level within the local printhead reservoir. As may be seen in FIG. 4, a substantially depleted reservoir (corresponding to FIG. 2(*b*)) requires a significantly longer refill time, tau-sub-B, than does a partially depleted reservoir (corresponding to FIG. 2(*c*)), tau-sub-C.

Figure 5:
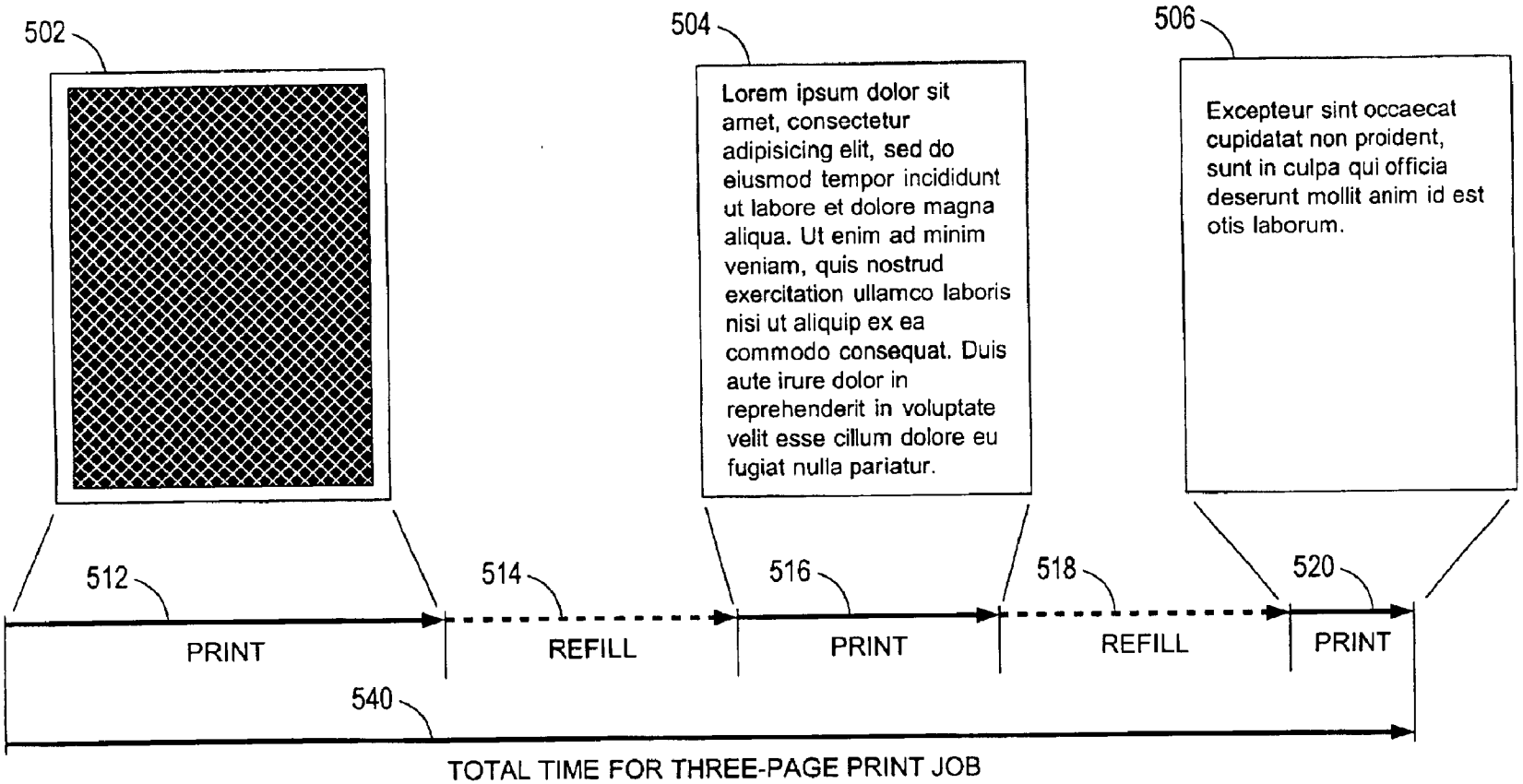
Fig. 5 (Prior Art)
FIG. 5 is an illustrative sample print job executed by an exemplary printing system utilizing intermittent replenishment of the printhead, but without embodiments of the present invention.

FIG. 5 shows an illustrative sample print job executed by an exemplary printing system utilizing intermittent replenishment of the printhead, but lacking the improvements of the present invention. The sample three-page print job includes a first page that is a very dense full-page image 502, such as a dark photograph. It is assumed in FIG. 5 that the local printhead reservoir carries sufficient ink to print only one such "full black" page. After printing the very dense page, the printer then prints a full page of text 504 followed by a partial page of text 506.

In a typical printing system, the time to print the dense image 512 will be longer than the time to print the full page of text 516, which in turn will be longer than the time to print the partial page of text 520. After printing each of the first two pages, the printhead is replenished 514, 518. The replenishment time is fixed, with refill time 514 equal to refill time 518. The total time required to print the three-page print job 540 is the sum of the times required to print the individual pages 512, 516, 520, plus the times required to refill the printhead after each page 514, 518.

Figure 6:
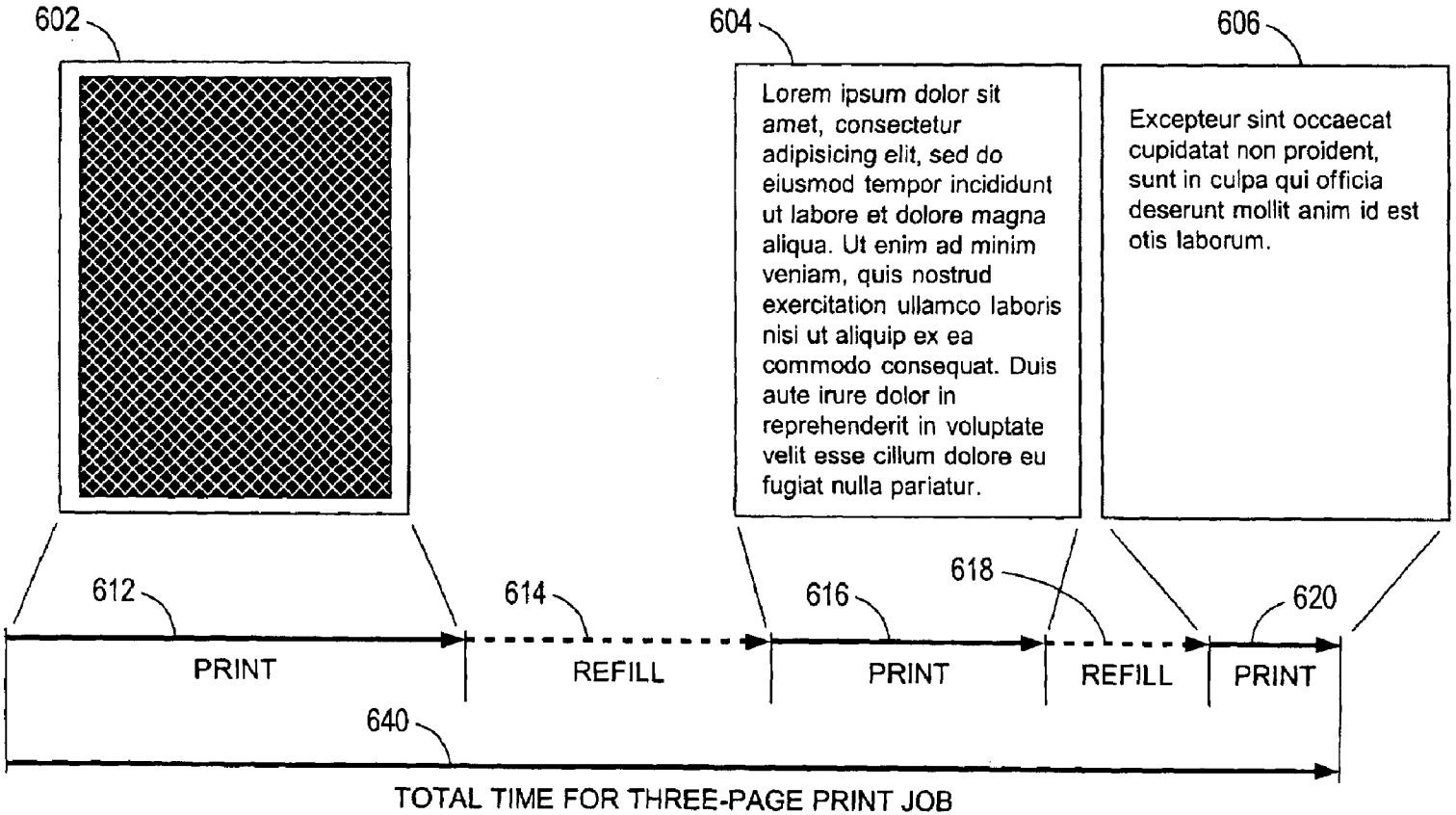
FIG. 6 is an illustrative sample print job executed by an exemplary printing system utilizing intermittent replenishment of the printhead according to one embodiment of the invention.

FIG. 6 shows an illustrative sample print job executed by an exemplary printing system incorporating an embodiment of the present invention. As in FIG. 5, the sample print job includes a very dense full-page image 602, a full page of text 604, and a partial page of text 606. The total print time for the three page print job 640 is the sum of the times required to print the individual pages 612, 616, 620, plus the times required to refill the printhead after each page 614, 618.

Unlike the sample print job of FIG. 5, however, the replenishment time is variable, with refill time 618 substantially less than refill time 614. For example, refill time 614 may correspond to tau-sub-B of FIG. 4, and refill time 618 may correspond to tau-sub-C. The total print job time 640 is therefore less than the total print job time 540 of FIG. 5. In determining the appropriate refill time, the printer controller (or print driver software) obtains an estimate of the ink used on the preceding portion of the print job, and determines a refill time based on the refill characteristics of the printhead. The estimate of ink used may be obtained from "drop counting" techniques known in the art, or from other analyses of the print data. The determination of refill time may be made, for example, from a look-up table similar to FIG. 4, or from an algorithmic representation of the refill characteristics in the form of a mathematical equation. The determination may take into account other factors, as discussed below. The table, equation, or some of the parameters used in making the determination may be stored in the memory device 116 of the replaceable supply.

Figure 7:
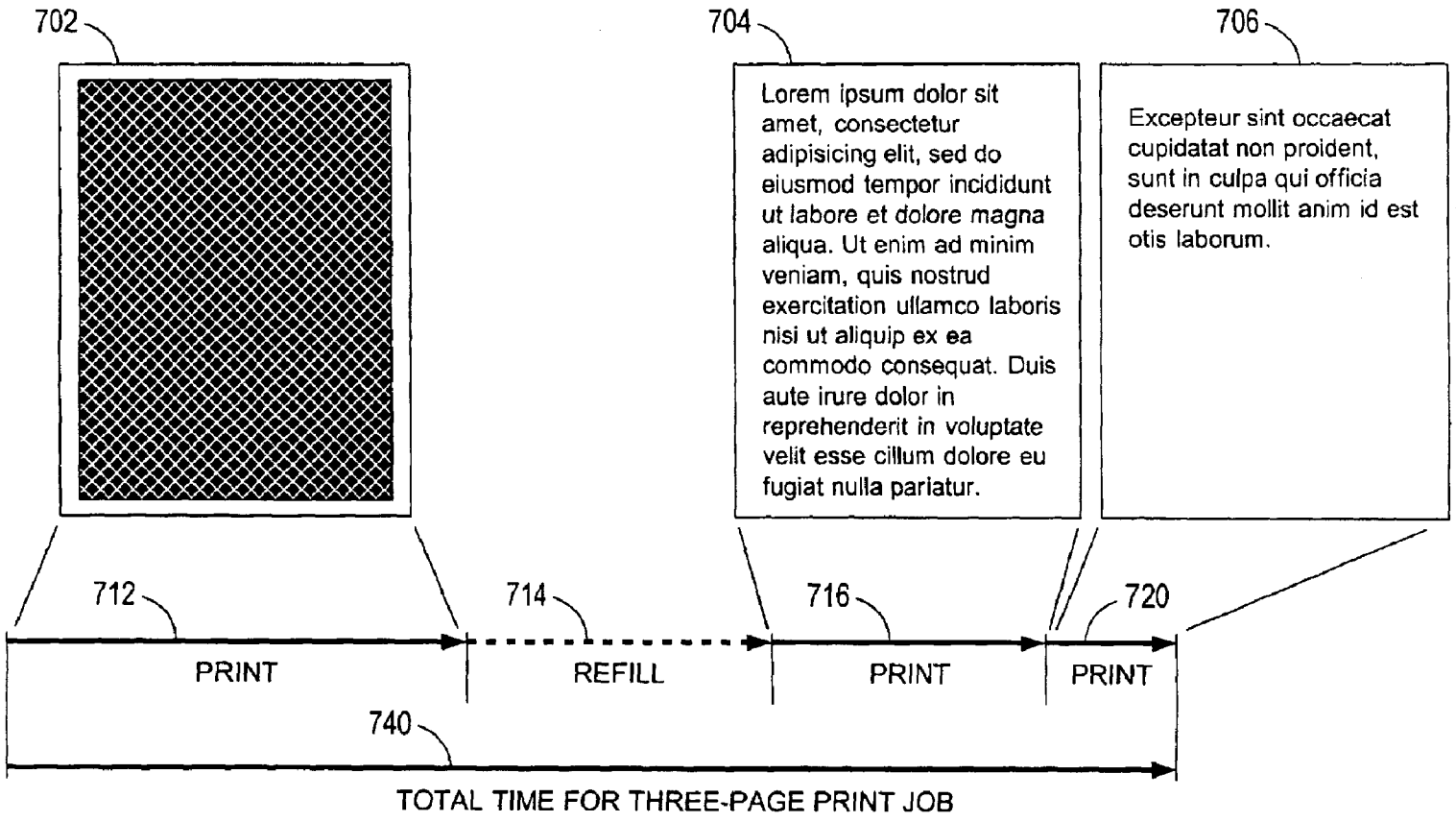
FIG. 7 is an illustrative sample print job executed by an exemplary printing system utilizing intermittent replenishment of the printhead according to a further embodiment of the invention.

FIG. 7 illustrates a further embodiment of the method of the invention. In the exemplary print job shown in FIG. 7, a very dense page requiring near the maximum amount of ink per page (for at least one of the printer colors) is printed 702, followed by a full page of text 704 and shorter, partial page of text 706. As discussed above, the very dense page may require a longer print time 712 then the full page of text 716, with the partial page of text requiring less time to print 720. Since the very dense page substantially depletes at least one of the local ink reservoirs in the printhead, the printhead reservoirs are replenished for a full refill time 714 after printing the page.

After printing the full page of text 704, however, the printhead local reservoir still contains a substantial quantity of ink. Rather than performing a refill for a shorter time period (such as period tau-C in FIG. 4), an embodiment of the invention contemplates the printing system "looking ahead" at the next portion of the print job, such as the next page to be printed, and determining whether the next portion of the print job can be completed without refilling the printhead. If the next portion of the print job can be completed without refilling the printhead, no refill is performed, and the total time 740 for the print job is accordingly reduced.

Figure 8A:
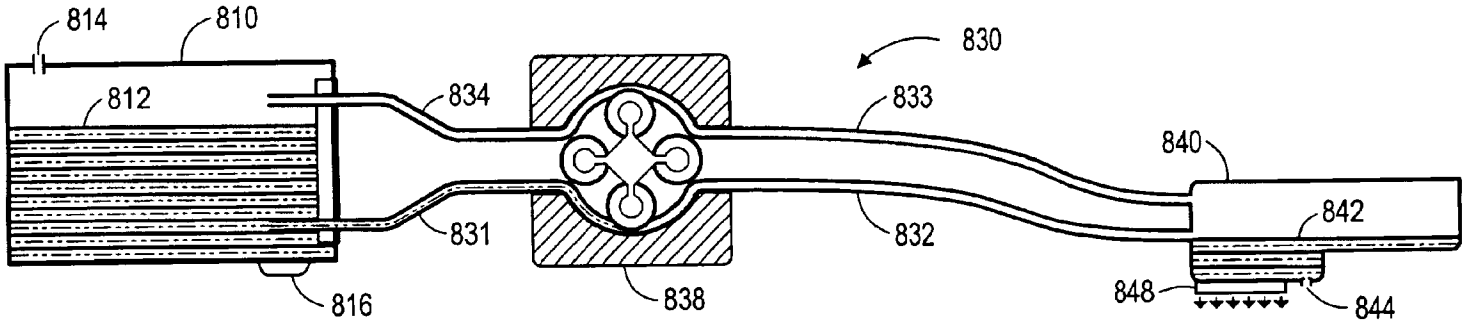
FIGS. 8(*a*) and 8(*b*) illustrate in simplified form a further exemplary printing system in which embodiments of the invention may be used.
Figure 8B:
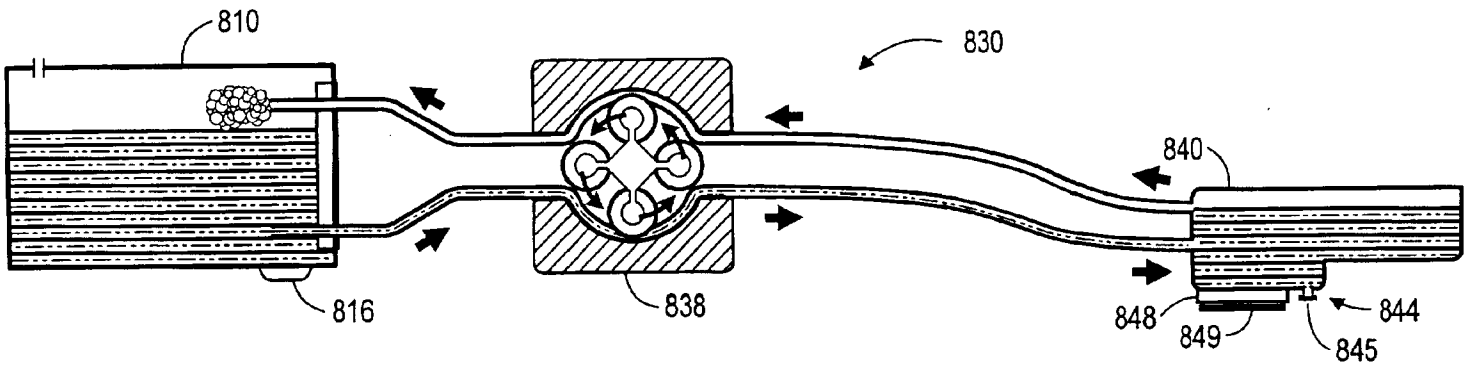

FIGS. 8(*a*) and 8(*b*) illustrate in simplified form a further exemplary printing system in which embodiments of the invention may be used. FIG. 8(*a*) shows the supply 810, ink delivery system 830, and printhead 840 of the system when printing, and FIG. 8(*b*) shows the supply 810, ink delivery system 830, and printhead 840 of the system during refill of the printhead.

The further exemplary printing system includes a "free ink" supply 810 containing a quantity of ink 812. The supply is vented 814 to the atmosphere and has an integral memory device 816 for storing information about the supply, the ink, or the printing system.

The ink delivery system of the further exemplary printing system recirculates ink from the supply 810 through tubes 831, 832 to the printhead 840, and return air, ink, and froth from the printhead to the supply through tubes 833, 834. The recirculation is driven by a pump, shown in FIGS. 8(*a*) and 8(*b*) as a peristaltic pump 838, which operates by compressing the ink tubes with rollers. Ink recirculation can allow for removal of air from the printhead, for cooling of the printhead, and for preventing thickening of ink in the printhead due to loss of fluid over time. The ink delivery system may also include other components, such as valves (not shown) actuated to isolate the printhead local reservoir from the ink delivery system when the printer is printing.

The printhead 840 of the further exemplary printing system is shown as having a local reservoir containing "free ink" 842, although a reservoir filled with a capillary material might also be used. The printhead includes a printhead die 848 for ejecting ink, and a pressure regulating mechanism 844 for maintaining an appropriate backpressure within the local reservoir, which may be in the form of a "bubbler" or other pressure regulating mechanism known in the art.

While "trailing tube" ink delivery systems may be configured to continuously provide ink to a printhead, in some printing systems it may be desirable to limit refill to non-printing times. For example, a single motor might be utilized to both propel the scanning carriage across the page and to operate a recirculation pump; to reduce costs the motor may be sized to perform only one these two functions at any one time. Or it may be desirable to limit pumping to non-printing intervals so as not to affect print quality. In lower-cost printing systems, to simplify aspects of the printhead or the ink delivery system, the printhead might in some manner be isolated or capped (as shown at 849), or the pressure regulating mechanism somehow inactivated (as shown at 845), during those times when ink is recirculated through the printhead.

In the case of a pump-driven ink delivery system as shown in FIGS. 8(*a*) and 8(*b*), the refill or replenishment time may be determined based on a known pump feed rate; the required pump time (tau) may be calculated as the volume of ink ejected since the last refill divided by the pump feed rate.

Figure 9:
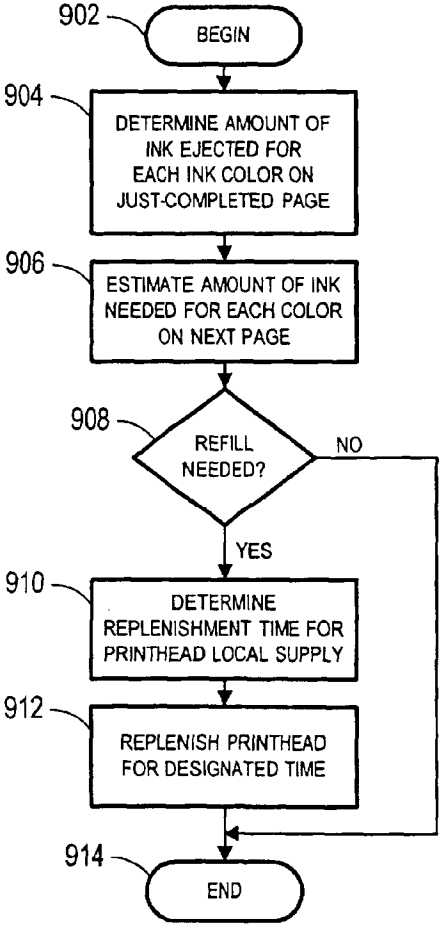
FIG. 9 is a flowchart of an exemplary embodiment of the method of the present invention.

FIG. 9 is a flowchart summarizing an exemplary embodiment of the invention. After a page is printed, the method begins 902 and determines the amount of ink ejected for each ink color on the just-completed page 904. During refill of the printhead in a "take-a-sip" or ink recirculation system, all the ink colors are typically refilled "in parallel", with all of the local ink reservoirs in the printhead replenished simultaneously. Since pages vary significantly in the quantity of each color required, the method bases a determination of the required refill time on the ink color that will require the longest refill time, which typically will be that color that was most used on the just-completed page (although other factors may influence the refill times, as discussed below). The determination of the amount of ink ejected for each color 904 may be an estimation based on an analysis of the data sent to each printhead (sometimes referred to as "drop counting"), or by other analysis of the print data. The determination may also be based on a direct measurement of the ink remaining in the printhead local reservoir.

In some embodiments of the method of the invention (such as depicted in FIG. 7) the method may also estimate the amount of ink needed for each color on the next page 906 through an analysis of the print data. Comparing the amount of ink needed on the next page to the quantities determined to remain in each of the local printhead reservoirs, the method may make a determination 908 that a refill is not required to complete printing of the next page, and the method will end 914 without performing a refill. In making such a determination, the method may also consider whether the next page is the last page in the print job, since a prolonged refill occurring after job completion is likely to be more acceptable to the printer user than a relatively short refill occurring between pages.

If the exemplary method determines that replenishment of the local printhead reservoir is needed, it then determines 910 the length of time required for replenishment. The replenishment time may be determined from tabular data, or from an equation, such as, for example, an equation approximating the curve of FIG. 4. The tabular data or equation is based primarily on the ink level remaining in the reservoir and the refill characteristics of the ink delivery system, but may be adjusted to take into account other factors and effects, as discussed below.

After the determining the time needed for replenishment, the printing system then replenishes the printhead reservoir for the designated reduced time 912, and the method ends 914.

Figure 10:
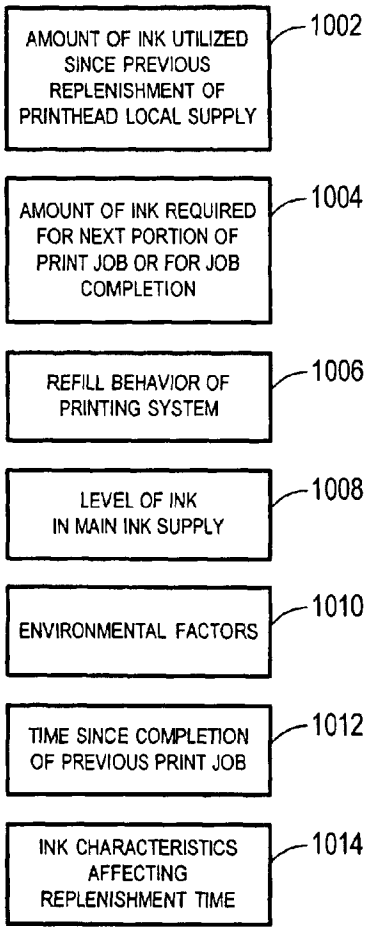
FIG. 10 illustrates some of the factors that may influence the refill time for the printhead local supply, and which may be considered in determining the reduced replenishment time.

FIG. 10 illustrates some of the factors that may influence the refill time for the printhead local supply, and which may be considered in determining the reduced replenishment time. These factors, individually or in combination, may be taken into account by the printer controller (or the printer driver) when setting the refill time. As discussed above, the determination includes an estimation of the amount of ink utilized since previous replenishment of printhead local supply 1002, and may also include an estimation of the amount of ink required for next portion of print job or for job completion 1004. The estimations may be made for each ink color, and may be made from an analysis of the print data for each page, for example.

The method may also consider information on the refill behavior of printing system 1006. For example, printing systems may have different ink delivery systems, or a printer may use a "free ink" supply rather than a supply containing a capillary material. If the supply or ink delivery system include capillary materials, the capillarity may differ depending on the material used, resulting in different refill times for different supplies. Other characteristics of the ink supply may also impact the flow rate of ink from the supply. The method may also take into account the level of ink in main ink supply 1008, since effects such as the height of the ink in the supply may influence refill time.

The method may also take into account environmental factors 1010, such as ambient temperature, and the time since completion of previous print job 1012, which may affect ink viscosity and the speed with which ink is adsorbed into the capillary material. Differences between ink types may also affect replenishment time 1014 (for example, cyan ink may have a higher viscosity than yellow ink, and hence may require a longer refill time).

Many of the factors enumerated above may be in the form of numerical parameters or tables of information that may be stored in the memory device associated with a replaceable ink supply. For example, the ink characteristics affecting refill time may be stored in the memory device at the time of manufacture; other parameters, such as the time the last print job was completed or the current level of ink the supply, may be updated periodically by the printer controller or print driver.

While the present invention has been particularly shown and described with reference to the foregoing exemplary and alternative embodiments, those skilled in the art will understand that many variations may be made therein without departing from the spirit and scope of the invention as defined in the following claims. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A method of reducing print-job completion time for a printer, the printer having a printhead provided with fluid through intermittent refill from an off-axis fluid supply during non-printing intervals, the fluid supply having an integral memory device, the method comprising:

obtaining information regarding the amount of fluid expended by the printhead since the most recent previous refill;

accessing the memory device on the off-axis supply to retrieve information indicative of factors relevant to printhead refill time;

determining, from the information concerning the current fluid level within the printhead and the information relevant to printhead refill times, a reduced refill time; and refilling the printhead for the reduced refill time.

2. The method of reducing print-job completion time for a printer of claim 1, wherein said fluid supply and said printhead are intermittently connectable during a refill mode, and are disconnected during printing operations performed by said printhead.

3. The method of reducing print-job completion time for a printer of claim 1, wherein said fluid supply and said printhead are connected by a fluid delivery system that provides fluid to the printhead only during non-printing intervals.

4. The method of reducing print-job completion time for a printer of claim 3, wherein the fluid delivery system recirculates fluid through the printhead and back to the fluid supply.

5. The method of reducing print-job completion time for a printer of claim 1, wherein obtaining information regarding the amount of fluid expended by the printhead since the most recent previous refill comprises analyzing the print data of printing performed since the most recent previous refill.

6. The method of reducing print-job completion time for a printer of claim 1, wherein the printer is configured to print more than one color of ink, and the step of analyzing the print data of printing performed since the most recent previous refill is performed for more than one separate color of ink.

7. The method of reducing print-job completion time for a printer of claim 6, wherein the step of determining a reduced refill time comprises determining which color of ink requires the longest refill time.

8. The method of reducing print-job completion time for a printer of claim 1, wherein the information indicative of factors relevant to printhead refill time comprises information concerning flow rate characteristics of the fluid supply.

9. The method of reducing print-job completion time for a printer of claim 1, wherein the information indicative of factors relevant to printhead refill time comprises information concerning characteristics of the fluid.

10. The method of reducing print-job completion time for a printer of claim 1, wherein the information indicative of factors relevant to printhead refill time comprises information concerning the amount of fluid remaining in the fluid supply.

11. The method of reducing print-job completion time for a printer of claim 1, wherein the step of determining a reduced refill time further comprises adjusting the refill time based on an indication of environmental factors.

12. The method of reducing print-job completion time for a printer of claim 11, wherein the environmental factors comprise the ambient temperature.

13. The method of reducing print-job completion time for a printer of claim 1, wherein the step of determining a reduced refill time further comprises adjusting the refill time based on an indication of the length of time that has passed since the last print job was completed was completed by the printer.

14. A method of reducing print-job completion time for a printer, the printer having a printhead provided with fluid through intermittent refill from an off-axis fluid supply during non-printing intervals, the fluid supply having an integral memory device, the method comprising:

obtaining information regarding the amount of fluid expended by the printhead since the most recent previous refill;

estimating the amount of fluid required to complete the next portion of the print job;

determining, from information regarding the amount of fluid expended by the printhead since the most recent previous refill and the estimate of the amount fluid required to complete the next portion of the print job, whether a refill of the printhead is required; and, if a refill is required, accessing the memory device on the off-axis supply to retrieve information indicative of factors relevant to printhead refill time;

determining, from the information concerning the current fluid level within the printhead and the information relevant to printhead refill times, a reduced refill time; and refilling the printhead for the reduced refill time.

15. The method of reducing print-job completion time for a printer of claim 14, wherein said fluid supply and said printhead are intermittently connectable during a refill mode, and are disconnected during printing operations performed by said printhead.

16. The method of reducing print-job completion time for a printer of claim 14, wherein said fluid supply and said printhead are connected by a fluid delivery system that provides fluid to the printhead only during non-printing intervals.

17. The method of reducing print-job completion time for a printer of claim 16, wherein the fluid delivery system recirculates fluid through the printhead and back to the fluid supply.

18. The method of reducing print-job completion time for a printer of claim 14, wherein obtaining information regarding the amount of fluid expended by the printhead since the most recent previous refill comprises analyzing the print data of printing performed since the most recent previous refill.

19. The method of reducing print-job completion time for a printer of claim 14, wherein the printer is configured to print more than one color of ink, and the step of analyzing the print data of printing performed since the most recent previous refill is performed for more than one separate color of ink.

20. The method of reducing print-job completion time for a printer of claim 19, wherein the step of determining a reduced refill time comprises determining which color of ink requires the longest refill time.

21. The method of reducing print-job completion time for a printer of claim 14, wherein the information indicative of factors relevant to printhead refill time comprises information concerning flow rate characteristics of the fluid supply.

22. The method of reducing print-job completion time for a printer of claim 14, wherein the information indicative of factors relevant to printhead refill time comprises information concerning characteristics of the fluid.

23. The method of reducing print-job completion time for a printer of claim 14, wherein the information indicative of factors relevant to printhead refill time comprises information concerning the amount of fluid remaining in the fluid supply.

24. The method of reducing print-job completion time for a printer of claim 14, wherein the step of determining a reduced refill time further comprises adjusting the refill time based on an indication of environmental factors.

25. The method of reducing print-job completion time for a printer of claim 24, wherein the environmental factors comprise the ambient temperature.

26. The method of reducing print-job completion time for a printer of claim 14, wherein the step of determining a reduced refill time further comprises adjusting the refill time based on an indication of the length of time that has passed since the last print job was completed was completed by the printer.

* * * * *

UNITED STATES PATENT AND TRADEMARK OFFICE

CERTIFICATE OF CORRECTION

PATENT NO. : 6,890,051 B2
APPLICATION NO. : 10/425366
DATED : May 10, 2005
INVENTOR(S) : David R. Otis, Jr.

It is certified that error appears in the above-identified patent and that said Letters Patent is hereby corrected as shown below:

In column 10, line 39, in Claim 13, after "job" delete "was completed".

In column 12, line 24, in Claim 26, after "job" delete "was completed".

Signed and Sealed this

Thirty-first Day of March, 2009

John Doll

JOHN DOLL
*Acting Director of the United States Patent and Trademark Office*